US005117080A

United States Patent [19]

Lee

[11] Patent Number: 5,117,080

[45] Date of Patent: May 26, 1992

[54] MICROWAVE OVEN WITH A FUNCTION FOR DRYING TABLEWARE AND A DRIVE CONTROL METHOD THEREOF

[75] Inventor: Kwan H. Lee, Kyungsangnam-Do, Rep. of Korea

[73] Assignee: Goldstar Co., Ltd., Seoul, Rep. of Korea

[21] Appl. No.: 575,566

[22] Filed: Aug. 31, 1990

[30] Foreign Application Priority Data

Aug. 31, 1989 [KR] Rep. of Korea ..... 12598/1989

[51] Int. Cl.[5] ..... H05B 6/80

[52] U.S. Cl. ..... 219/10.55 R; 219/10.55 B; 219/10.55 E; 219/10.55 M; 99/DIG. 14

[58] Field of Search ..... 219/10.55 E, 10.55 F, 219/10.55 R, 10.55 D, 10.55 B, 10.55 M; 34/1; 99/DIG. 14, 451

[56] References Cited

U.S. PATENT DOCUMENTS

| | | | |
|---|---|---|---|
| 3,451,401 | 6/1969 | Levinson | 219/10.55 R |
| 3,494,722 | 2/1970 | Gray | 219/10.55 R |
| 3,670,746 | 6/1972 | Gehrmann | 219/10.55 R |
| 4,471,195 | 9/1984 | Ishii et al. | 219/10.55 E |

*Primary Examiner*—Philip H. Leung

[57] ABSTRACT

A microwave oven with a function for drying tableware dryer. The microwave oven includes a heater and a magnetron controlled by a microcomputer, a tableware basket holder detachably equipped with a tableware basket, a water bucket and a plate. A tableware basket holder sensing section is mounted for sensing the tableware basket holder when it is inserted in a cavity of the microwave oven. The tableware drying function is performed by driving the heater under the control of the microcomputer when a tableware basket holder sensing signal is generated from the tableware basket holder sensing section.

2 Claims, 3 Drawing Sheets

MICROWAVE OVEN WITH A FUNCTION FOR DRYING TABLEWARE AND A DRIVE CONTROL METHOD THEREOF

BACKGROUND OF THE PRESENT INVENTION

1. Field of the Present Invention

The present invention relates to a convention microwave oven and more particularly, to a microwave oven with a function of a tableware dryer and a drive control method thereof for enabling the microwave oven to be used as a tableware dryer.

2. Description of the Prior Art

Various types of microwave ovens are well known in the art. Such microwave ovens do not have a function of a tableware dryer. Such microwave ovens have only a function of heating food. As shown in FIGS. 1A and 1B, a conventional microwave oven of such microwave ovens comprises a magnetron 4 for generating a high frequency, a waveguide 5 for transferring to a cavity 1 the high frequency generated from the magnetron 4, a turntable 3 mounted on the bottom of the cavity for turning food, a roller 9 for supporting and smoothly driving the turntable 3, a turn table motor 2 for driving the turntable 3, a heater 6 mounted on the rear portion of the cavity 1 for generating heat, and a ventilator 7 for blowing into the cavity 1 the heat generated from the heater 6.

The microwave oven, after placing food on the turntable 3, is switched on, and a high frequency is generated out of the magnetron 4. The frequency is conducted to the cavity 1 through the waveguide 6, and thus, the food on the turntable 3 is evenly heated while the turntable 3 is turned by the turntable motor 2.

Meantime, in order to cook the food on the-turntable 3 with heat, the magnetron 4 is not driven. The heater 6 and the ventilator 7 are driven so that the food on the turntable 3 is heated since the heat generated from the heater 6 is transferred into the cavity 1 by the ventilator 7.

And also, a conventional stirrer fan type microwave oven heats the food on the glass dish evenly therein since the stirrer fan evenly spreads the high frequency into the cavity thereof.

As mentioned above, the conventional microwave ovens do not have a function for drying tableware, but only the function of heating food.

However, when metal tableware is put in the cavity of the microwave oven for drying, sparks are created due to the high frequency. Therefore, such conventional microwave ovens have a drawback in that they cannot be used as a tableware dryer.

SUMMARY OF THE PRESENT INVENTION

Accordingly, it is an object of the present invention to provide a microwave oven with a function for drying tableware dryer wherein the function can be changed from food heating to tableware drying.

Another object of the present invention is to provide a microwave oven which performs a food heating function in case that the tableware basket holder is not in the cavity of the microwave oven so that to dry the tableware in the tableware basket, heat is generated from a heater and a ventilator is driven for a predetermined time while a magnetron is not driven. The tableware basket holder can be easily put in the cavity of the microwave oven.

Other objects and further scope of applicability of the present invention will become apparent from the detailed description given below. It should be understood, however, that the detailed description and specific examples, while indicating preferred embodiments of the present invention, are given by way of illustration only, since various changes and modifications within the spirit and scope of the present invention will become apparent to those skilled in the art from this detailed description.

Briefly described, the present invention relates to a microwave oven with a function for drying tableware in a microwave oven which includes a heater and a magnetron controlled by a microcomputer, a tableware basket holder detachably equipped with a tableware basket, a water bucket and a plate, and a tableware basket holder sensing section mounted to sense the tableware basket holder which is inserted in a cavity thereof, whereby a tableware drying function is performed by driving the heater with control of the microcomputer when a tableware basket holer sensing signal is generated from the tableware basket holder sensing section.

BRIEF DESCRIPTION OF THE DRAWINGS

The present invention will become more fully understood from the detailed description given below and the accompanying drawings which are given by way of illustration only, and thus are not limitative of the present invention, and wherein.

DESCRIPTION OF THE PREFERRED EMBODIMENTS

Figure 1A:
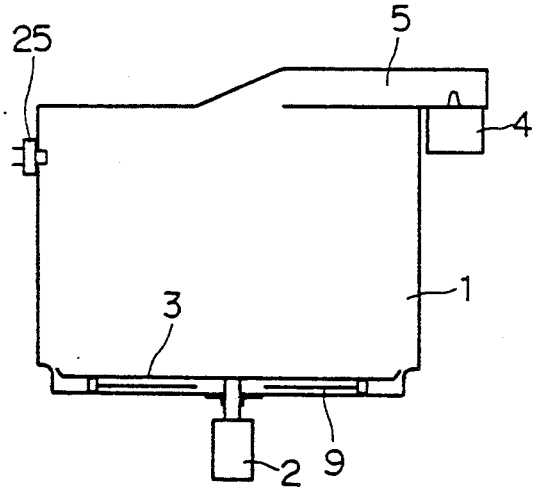
FIG. 1A CONVENTIONAL ART
FIGS. 1(A) and 1(B) are front sectional view and left side views of a conventional microwave oven to which the present invention is applied.
Figure 1B:
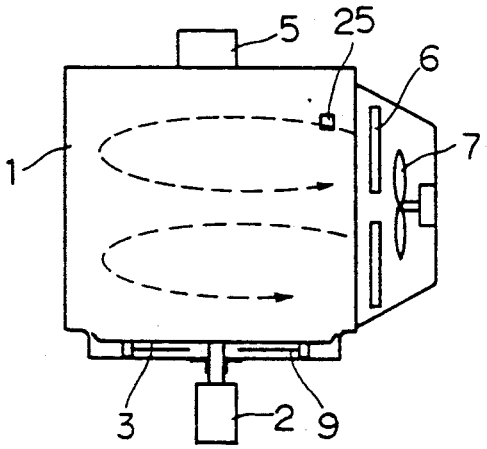
FIG. 1B CONVENTIONAL ART
Figure 2:
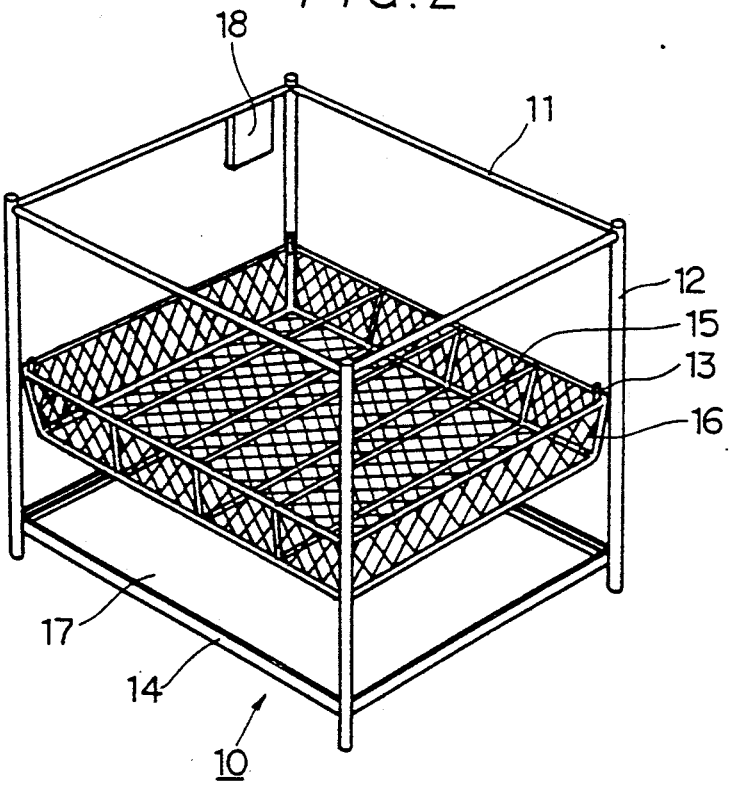
FIG. 2 is a prospective view of a tableware basket holder according to the present invention.

Referring now in detail to the drawings for the purpose of illustrating preferred embodiments of the present invention, the microwave oven with a function for drying tableware and a drive control method thereof as shown in FIGS. 1A, 1B, 2, and 3 comprises a microwave oven equipped with a heater 6 and a magnetron 4, a tableware basket holder 10 built with an upper supporter 11 and an lower supporter 14 in a rectangular shape. Corners of the tableware basket holder 10 are fixed at support bars 12. Hooks 13 are formed on the middle point of each of the support bars 12. A tableware basket 16 is equipped with a plural number of compartments 15 and is able to be hung from the hooks 13. A water bucket 17 is supported by the lower supporter 14, and a plate 18 is attached to one bar of the supporter 11.

The tableware basket holder 10 made of plastic is formed in a suitable size in order to be put in a cavity 1 (FIG. 1) and the tableware basket 16 is constructed with a net shape for a good air flow. And also, a tableware basket holder sensing section 25 is mounted on an upper part of the left wall of the cavity 1, which is opposite of a plate 18 when the tableware basket holder 10 is put in the cavity 1.

Figure 3:
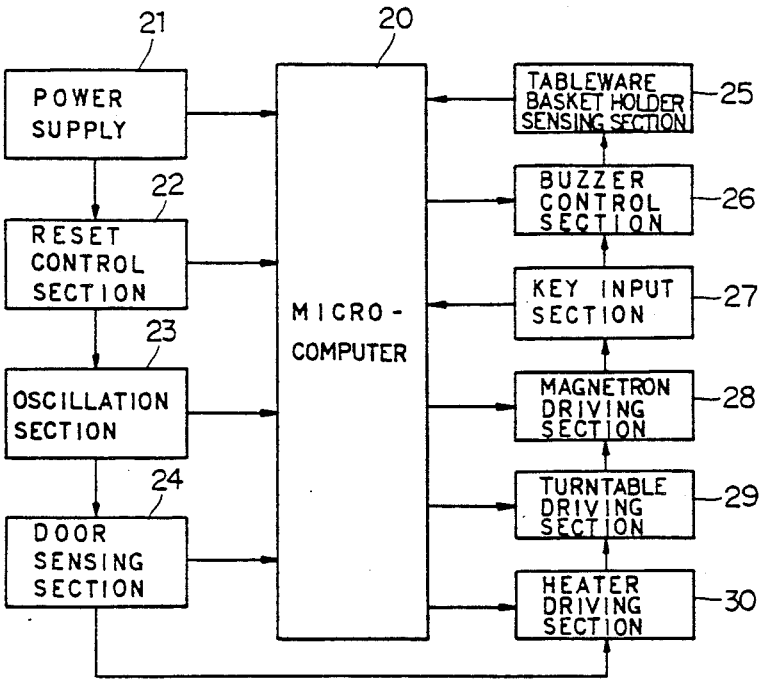
FIG. 3 is a control block diagram according to the present invention.

As shown in FIG. 3, the microwave oven is structured such that electric power is supplied from a power supply 21. The microwave oven includes a reset control section 22, an oscillation section 23, a door sensing section 24, a key input section 27 for a microcomputer 20, a buzzer control section 26, a magnetron driving section 28, a turntable driving section 29, a heater driving section 30 controlled by the microcomputer 20. An output terminal of the tableware basket holder sensing section 25 is connected to the microcomputer 20. The microcomputer 20 drives the heater driving section 30 for a predetermined time while not driving the magnetron driving section 28 and the turntable driving section 29 when the tableware basket holder sensing signal from the tableware basket holder sensing section 25 is applied to the microcomputer 20.

Figure 4:
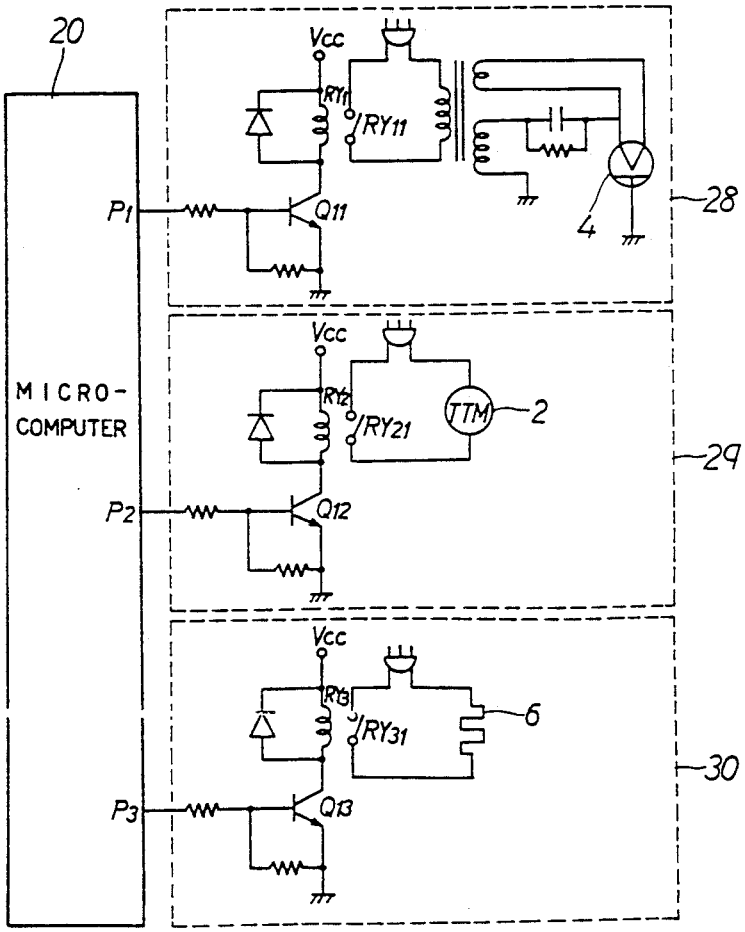
FIG. 4 shows detailed circuits for driving sections of FIG. 3.

FIG. 4 shows detailed circuits for the magnetron driving section 28, the turntable driving section 29, and the heater driving section 30 of FIG. 3.

As shown in FIG. 4, the magnetron driving section 28 is built so that the magnetron 4 is driven by activating a relay RY1 when a magnetron driving signal appears at an output terminal P1 of the microcomputer 20 which turn ON transistor Q11. The turntable driving section 29 is constructed such that the turntable motor 2 is driven by activating a relay RY2 active when a turntable driving signal appears at an output terminal P2 of the microcomputer 20 which turns ON a transistor Q12. The heater driving section 30 is structured such that the heater 6 is driven by activating relay RY3 when a heater driving signal appeared at an output terminal P3 of the microcomputer 20 turns a transistor Q13 on.

The microwave oven according to the present invention operates as follows.

Figure 5:
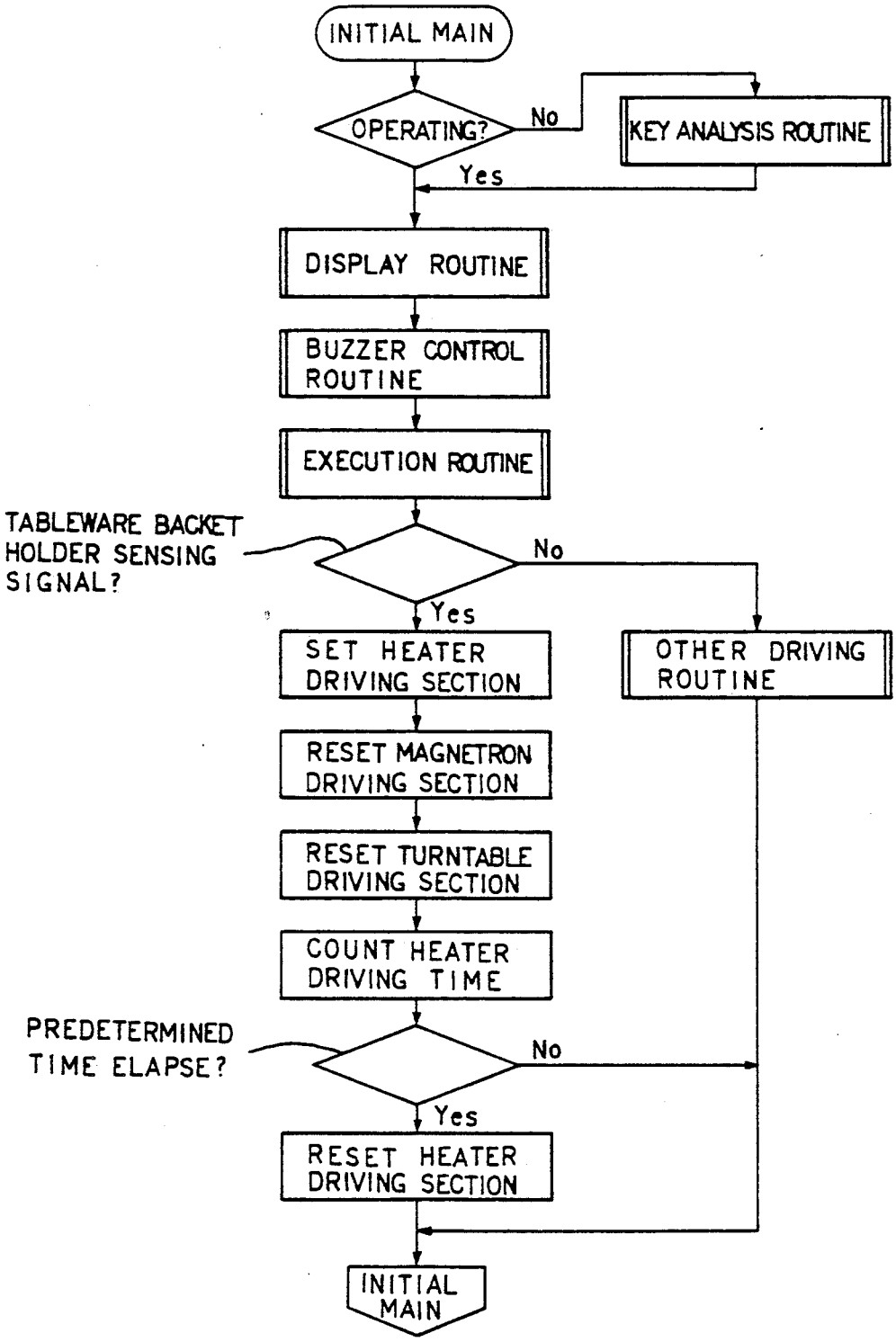
FIG. 5 is a flow chart for microcomputer signals of FIG. 3.

As shown in FIG. 5, the same operations as those of the conventional microwave ovens are applied to the present invention when the tableware basket holder 10 is not inserted in the cavity 1, because a tableware basket holder sensing signal is not produced from the tableware basket holder sensing section 25. Meanwhile, when the tableware basket holder 10 with tableware is inserted in the cavity 1, a tableware basket holder sensing signal is generated from the tableware basket sensing section 25 opposite to the plate 18 and applied to the microcomputer 20, whereby the microcomputer 20 sets up a tableware drying execution mode to perform the tableware drying function as shown in the flow chart of FIG. 5.

At this time, the microcomputer 20 sets its output terminal P3 and resets its output terminals P1 and P2, whereby the low potential signals which turn OFF transistors Q11 and Q12 prepresent at the output terminals P1 and P2 of the microcomputer 20. Accordingly, the magnetron 4 and the turntable motor 2 are not driven since switches RY11 and RY12 are kept open by relays RY1 and RY2. Therefore, no high frequency is transferred into the cavity 1 because the magnetron 4 is not activated to generate a high frequency, and the turntable 3 does not turn.

Also, at this time, a transistor Q13 is turned ON due to a high potential signal at the output terminal P3 of the microcomputer 20, whereby a switch RY31 is so closed by relay RT3 such that an AC current passes through the heater 6 to generate heat from the heater 6.

The generated heat is sent into the cavity 1 by the ventilator 7 so that the heat dries the tableware in the tableware basket 16 which is held in the tableware basket holder 10. Thereafter, the microcomputer 20 resets the output terminal P3 to convert its output to a low potential signal just after an elapse of the predetermined time. This low potential signal turn OFF the transistor Q13 so that relay RY3 is not driven anymore, thereby putting to an end to the tableware drying function. Also, by detaching the plate 18 from the tableware basket holder 10, the food heating function can be performed when the tableware basket holder 10 is not inserted in the cavity 1.

When the plate 18 is detached, no tableware basket holder sensing signal is produced form the tableware basket sensing section 26 so that food can be heated using the same operations as those of as conventional microwave ovens as described above.

When the tableware basket holder 10 is not built in the cavity 1 has been described here. The tableware basket holder 10 may be built in the cavity 1 by making the tableware basket holder 10 round.

As described above in detail, the microwave oven, according to the present invention allows the sanitary management of tableware can be offered and more convenience can be offered to the users, since the microwave oven can be used as a tableware dryer.

The present invention being thus described, it will be obvious that the same may be varied in many ways. Such variations are not to be regarded as a departure from the spirit and scope of the present invention, and all such modifications as would be obvious to one skilled in the art are intended to be included in the scope of the following claims.

What is claimed is:

1. A microwave oven with a function for drying tableware, comprising:

a microwave oven including, a cavity, a heater, a magnetron, and a microcomputer for controlling said heater and said magnetron;

a tableware basket holder detachably connected to said cavity in said microwave oven;

said tableware basket holder including, a tableware basket, a water bucket, and a plate; and tableware basket holder sensing means for sensing said tableware basket holder in said cavity of said microwave oven;

said microcomputer driving said heater when said tableware basket holder sensing means senses said tableware basket holder is in said microwave oven, thereby performing a tableware drying function.

2. A method for controlling a microwave oven with a function for drying tableware, comprising the steps of:

(a) sensing whether a tableware basket holder is in the microwave oven;

(b) heating food by operating a magnetron and operating a turntable when said step (a) does not sense the tableware basket holder in the microwave oven; and (c) drying tableware by operating a heater, not operating the magnetron, and not operating the turntable when said step (a) senses that the tableware basket holder is in the microwave oven.

* * * * *